US009596910B2

(12) United States Patent
Grossenbacher et al.

(10) Patent No.: US 9,596,910 B2
(45) Date of Patent: Mar. 21, 2017

(54) INVISIBLE SET DECORATIVE PART

(71) Applicant: Dress Your Body AG, Cormondrèce (CH)

(72) Inventors: Pascal Grossenbacher, Neuchâtel (CH); Julien Meier, Neuchâtel (CH); Michel Caillaud, Villers-le-Lac (FR); Stéphane Lauper, Corcelles (CH); Arlette-Elsa Emch, La Neuveville (CH)

(73) Assignee: DRESS YOUR BODY AG, Cormondreche (CH)

( * ) Notice: Subject to any disclaimer, the term of this patent is extended or adjusted under 35 U.S.C. 154(b) by 0 days.

(21) Appl. No.: 14/872,372

(22) Filed: Oct. 1, 2015

(65) Prior Publication Data

US 2016/0073746 A1 Mar. 17, 2016

Related U.S. Application Data

(62) Division of application No. 13/503,757, filed as application No. PCT/EP2010/067135 on Nov. 9, 2010.

(30) Foreign Application Priority Data

Nov. 25, 2009 (EP) ..... 09176994
Jun. 25, 2010 (CH) ..... 1045/10

(51) Int. Cl.
*A44C 17/02* (2006.01)
*A44C 17/04* (2006.01)
(Continued)

(52) U.S. Cl.
CPC ..... *A44C 17/005* (2013.01); *A44C 17/02* (2013.01); *A44C 17/04* (2013.01); *C25D 5/00* (2013.01);
(Continued)

(58) Field of Classification Search
CPC ..... C25D 5/00; C25D 7/00
See application file for complete search history.

(56) References Cited

U.S. PATENT DOCUMENTS 1,392,604 A 10/1921 Smith
2,525,465 A 10/1950 Swarovski
(Continued)

FOREIGN PATENT DOCUMENTS

CH 649 697 A5 6/1985
CH 688 982 A5 6/1998
(Continued)

OTHER PUBLICATIONS

Search Report issued in corresponding International Application PCT/EP2010/067135, completed Jan. 6, 2011 and mailed Jan. 17, 2011.
(Continued)

*Primary Examiner* — Stefanie S Wittenberg
(74) *Attorney, Agent, or Firm* — Oblon, McClelland, Maier & Neustadt, L.L.P.

(57) ABSTRACT

The invention relates to a decorative part (1, 3, 5) including several stones (2) and a device (7, 7', 47, 47') for securing the stones (2) in relation to each other. According to the invention, the securing device (7, 7', 47, 47') includes a single electrodeposited base (9, 9', 49, 49') whose shape matches one part of the stones, thus allowing all the stones (2) to be attached in relation to each other without any stress, and the girdles (6) of the stones (2) are mounted edge-to-edge in relation to each other so that the single base is concealed. The invention also relates to the method for manufacturing a part (1, 3, 5) of this type.

6 Claims, 7 Drawing Sheets

(51) Int. Cl.
*C25D 5/00* (2006.01)
*C25D 7/00* (2006.01)
*A44C 17/00* (2006.01)

(52) U.S. Cl.
CPC ..... *C25D 7/00* (2013.01); *Y10T 428/12389* (2015.01); *Y10T 428/12535* (2015.01)

(56) References Cited

U.S. PATENT DOCUMENTS

| | | | | |
|---|---|---|---|---|
| 3,931,719 | A | 1/1976 | Schwab | |
| 3,963,309 | A | 6/1976 | Schwab | |
| 4,052,863 | A | 10/1977 | Poll | |
| 4,247,372 | A * | 1/1981 | Nobel | C25D 5/34 205/133 |
| 4,353,765 | A | 10/1982 | Covi et al. | |
| 4,543,803 | A * | 10/1985 | Keyasko | A44C 15/00 205/114 |
| 4,813,246 | A | 3/1989 | Richards | |
| 5,119,350 | A | 6/1992 | Delacretaz et al. | |
| 5,123,265 | A | 6/1992 | Ramot | |
| 5,338,591 | A | 8/1994 | Poll | |
| 5,423,196 | A | 6/1995 | Pollack | |
| 5,520,017 | A | 5/1996 | Vivat | |
| 5,669,240 | A | 9/1997 | Lima | |
| 6,000,240 | A | 12/1999 | Noda | |
| 6,003,335 | A | 12/1999 | Gurevich et al. | |
| 6,112,552 | A | 9/2000 | Hoffman | |
| 6,212,745 | B1 | 4/2001 | Pierre et al. | |
| 6,226,232 | B1 | 5/2001 | Ruchonnet | |
| 6,293,129 | B1 | 9/2001 | Gurevich | |
| 6,928,834 | B2 | 8/2005 | Robertson et al. | |
| 6,997,014 | B2 | 2/2006 | Starcke et al. | |
| 7,120,093 | B2 | 10/2006 | Lazaretnik | |
| 7,137,275 | B2 | 11/2006 | Starcke et al. | |
| 7,596,967 | B2 | 10/2009 | Ostfeld | |
| 2004/0172969 | A1 | 9/2004 | Buchberger et al. | |
| 2008/0066310 | A1 | 3/2008 | Pang | |
| 2008/0209943 | A1 | 9/2008 | Mattar | |

FOREIGN PATENT DOCUMENTS

| | | | | |
|---|---|---|---|---|
| DE | 203 11 000 | U1 | 2/2004 | |
| DE | 20 2004 014894 | U1 | 1/2005 | |
| EP | 0 555 753 | A | 8/1993 | |
| GB | 798 080 | | 7/1958 | |
| GB | 2 136 672 | A | 9/1984 | |
| WO | 98/59196 | A | 12/1998 | |
| WO | 00/57743 | | 10/2000 | |
| WO | WO2008130079 | * | 10/2008 | C25D 3/00 |

OTHER PUBLICATIONS

"Bespoke Gems—Fine Handcut Gemstones—Precious and Semi Precious Gemstones—What to Look for When Choosing a Gemstone," at http://www.bespoke-gems.com/SacredGeometrics_Page_WhatToLookFor.php (downloaded Sep. 18, 2013, eight pages).
Random House Webster's College Dictionary 554 (1991).
Ultraviolet & Fluorescence Photography (Eastman Kodak Company 1972).
http://www.allindianpatents.com/patents/207959 (downloaded Sep. 23, 2013) and related documents hyperlinked to this webpage, which are filed collectively as "Exhibit A.".
"Dial Less Watch," at http://innovativeinventionhub.com/dial-less-watch/ (Sep. 16, 2013).
"Faceless, Dial-less Wristwatch Leaps From Concept to Counter," at http://inventorspot.com/articles/faceless_dialless_wristwatch_leaps_concept_counter (Halcyon Solutions Inc. 2013).
International Search Report issued in related application No. PCT/EP2009/053888, completed Jul. 7, 2009 and mailed Jul. 20, 2009.
Settings, http://www.makermends.com/settings.html (downloaded Jan. 16, 2015, 10:59AM).

* cited by examiner

INVISIBLE SET DECORATIVE PART

This is a Divisional application of Ser. No. 13/503,757, filed Apr. 24, 2012, which is a National Phase Application in the United States of International Patent Application PCT/EP2010/067135 filed Nov. 9, 2010, which claims priority on European Patent Application No. 09176994.3 of Nov. 25, 2009 and on Swiss Patent Application No. 01045/10 of Jun. 25, 2010. The entire disclosures of the above patent applications are hereby incorporated by reference.

FIELD OF THE INVENTION

The invention relates to an invisible set decorative part and, more specifically, to a decorative part for a piece of jewelry forming a stone pavé setting able to decorate a surface.

BACKGROUND OF THE INVENTION

It is known to set precious, semi-precious or synthetic stones using prongs, beads or channels. Invisible settings also exist which secure the stones via their pavilion or crown. In the current state of the art of invisible settings, there exist numerous methods (using milling, casting, clips, screws, etc.) which, according to well defined systems, have multiple drawbacks: the nature, geometry and dimensions of the stones are often limited, the height, depth and angles of the grooves are often restrictive, there are scratches, chips, and fissures cracks in the stones during operations, or repairs when a change of stone causes chips on adjacent stones, etc. . . . Furthermore, the majority of these methods require the manual intervention of a setter during the setting operation. Even if the setter is highly qualified, there is a permanent risk of the stones being lost, scratched, cracked or chipped.

SUMMARY OF THE INVENTION

It is an object of the present invention to overcome all of part of the aforecited drawbacks by proposing an industrial manufacturing method for obtaining a homogeneous arrangement of the stones, diversity of shape, improved precision and a higher quality setting at a lower cost. The invention therefore relates to a decorative part including several stones and a device for securing the stones in relation to each other, characterized in that the securing device includes a single electroplated base whose shape matches one part of the stones, allowing all the stones to be attached in relation to each other without any stress, and in that the stone girdles are mounted edge-to-edge in relation to each other so that the single base is concealed.

Advantageously according to the invention, the base is formed in accordance with the dispersions in the cuts and dimensions of the stones, which avoids generating internal stresses in the stones. Because it is electroplated, the base immediately fits the shapes of the stones.

In accordance with other advantageous features of the invention:

(a) the securing device attaches the stones to each other via their pavilion or crown;
(b) the single base covers or does not cover all of the pavilions or crowns of the stones;
(c) the securing device includes at least one groove made in at least one of the stones in the pavilion or crown thereof so that the single base, whose shape at least partially matches each stone, forms at least one hook for each of the stones;

(d) the at least one groove forms two slots in two surfaces of the stone;
(e) the single base has at least one electrically conductive layer deposited on the stones,
(f) the single base includes at least one electrically conductive layer deposited on the stones;
(g) the single base includes a second layer electrodeposited from the at least one electrically conductive layer so as to improve the solidity of the decorative part;
(h) the at least one electrically conductive layer is used as a reflective layer; and
(i) the single base includes pure silver and a protective layer covering the silver to prevent it being tarnished by oxidation.

The invention also relates to a piece of jewelry and a timepiece, characterized in that they include an added decorative part according to any of the preceding variants.

Finally, the invention relates to a method for manufacturing a decorative part, characterized in that it includes the following steps:

(a) taking several stones;
(b) securing each stone against a support, the girdles of the stones being mounted edge-to-edge in relation to each other so as to form a pavé stone setting;
(c) depositing a first electrically conductive layer on at least one part of the stones;
(d) electrodepositing a second layer from the first electrically conductive layer so as to form a single base;
(e) removing the decorative part thereby formed by detaching each of the stones from the support.

In accordance with other advantageous features of the invention:

(i) between step (a) and step (b) the method further includes step (f): etching at least one groove in the pavilions of the stones so that the single base electrodeposited in step (d) fills each of the at least one groove thus forming a securing hook and, in step (c), the first layer is deposited over at least one part of the pavilions of the stones;
(ii) between step (a) and step (b), the method includes step (f): etching at least one groove in the crowns of the stones so that the single base electrodeposited in step (d) fills each of the at least one groove thus forming a securing hook, and in step (c), the first layer is deposited over at least one part of the crowns of the stones;
(iii) the support includes cavities for receiving the stones;
(iv) between step (c) and step (d), the method includes step (g): forming a frame around the pavé setting so as to delimit the electrolytic deposition of step (d) above the girdles of the stones; and
(v) step (c) is achieved by spraying a fluid including silver powder.

Thus, in accordance with a first non-limiting illustrative embodiment of the present invention, a decorative part (1, 3, 5) is provided that includes several stones (2) and a device (7, 7', 47, 47') for securing the stones (2) in relation to each other, characterized in that the securing device (7, 7', 47, 47') includes a single electrodeposited base (9, 9', 49, 49') whose shape matches one part of the stones, allowing all the stones (2) to be attached in relation to each other without any stress, and in that the girdles (6) of the stones (2) are mounted edge-to-edge in relation to each other so that the single base is concealed. In accordance with a second non-limiting illustrative embodiment of the present invention, the first non-limiting embodiment is modified so that the securing device (7, 7') attaches the stones one by one in relation to each other via the pavilion thereof (4). In accordance with a third non-limiting, illustrative embodiment of the present invention, the first and second non-limiting embodiments are modified so that the single base (9) covers all of the pavilions (4) of the stones. In accordance with a fourth non-limiting embodiment of the present invention, the second non-limiting embodiment is further modified so that the single base (9') leaves one part of the pavilions (4) of the stones uncovered.

In accordance with a fifth non-limiting illustrative embodiment of the present invention, the first non-limiting embodiment is modified so that the securing device (47, 47') attaches the stones in relation to each other via the crown thereof (18). In accordance with a sixth non-limiting illustrative embodiment of the present invention, the fifth non-limiting embodiment is further modified so that the single base (49) covers all of the tables (8) of the stones. In accordance with a seventh non-limiting illustrative embodiment of the present invention, the fifth non-limiting embodiment is further modified so that the single base (49') leaves one part of the tables (8) of the stones uncovered.

In accordance with an eighth non-limiting illustrative embodiment of the present invention, the first, second, third, fourth, fifth, sixth and seventh non-limiting embodiments are further modified so that the securing device (7, 7', 47, 47') includes at least one groove (10, 50) made in at least one of the stones (2) so that the single base (9, 9', 49, 49'), of at least partially matching shape, forms at least one hook for each of the at least one of the stones (2). In accordance with a ninth non-limiting illustrative embodiment of the present invention, the eighth non-limiting embodiment is further modified so that the at least one groove (10, 50) forms two slots in two surfaces of each stone (2).

In accordance with a tenth non-limiting illustrative embodiment of the present invention, the first, second, third, fourth, fifth, sixth, seventh, eighth and ninth non-limiting embodiments are further modified so that the base (9, 9', 49, 49') has at least one electrically conductive layer (11, 11', 51, 51') deposited on the stones (2). In accordance with an eleventh non-limiting illustrative embodiment of the present invention, the tenth non-limiting embodiment is further modified so that the single base (9, 9', 49, 49') includes a second layer (13, 13', 53, 53') electrodeposited from the at least one electrically conductive layer so as to improve the solidity of the decorative part (1, 3, 5). In accordance with a twelfth non-limiting illustrative embodiment of the present invention, the tenth or eleventh non-limiting embodiments are further modified so that the at least one electrically conductive layer (11, 11', 51, 51') is used as a reflective layer. In accordance with a thirteenth non-limiting embodiment of the present invention, the first, second, third, fourth, fifth, sixth, seventh, eighth, ninth, tenth, eleventh and twelfth non-limiting embodiments are further modified so that the single base (9, 9', 49, 49') includes pure silver and a protective layer covering the silver to prevent the tarnishing thereof by oxidation.

In accordance with a fourteenth non-limiting illustrative embodiment of the present invention, a timepiece is provided and characterized in that it includes at least one decorative part (1, 3, 5) according to any of the first, second, third, fourth, fifth, sixth, seventh, eighth, ninth, tenth, eleventh, twelfth and thirteenth non-limiting embodiments of the invention. In accordance with a fifteenth non-limiting illustrative embodiment of the present invention, a piece of jewelry is provided, which includes at least one decorative part (1, 3, 5) according to any one of the first, second, third, fourth, fifth, sixth, seventh, eighth, ninth, tenth, eleventh, twelfth and thirteenth non-limiting embodiments of the invention.

In accordance with a sixteenth non-limiting illustrative embodiment of the present invention, a method (21) of manufacturing a decorative part (1, 3, 5) is provided that includes the following steps: (a) taking (23) several stones (2); (b) securing (25) each stone (2) against a support (12, 52), wherein the girdles (6) of the stones (2) are mounted edge-to-edge in relation to each other so as to form a pavé stone (2) setting; (c) depositing (27) a first electrically conductive layer (11, 11', 51, 51') on at least one part of the stones (2); (d) electrodepositing (29) a second layer (13, 13', 53, 53') from the first electrically conductive layer so as to form a single base (9, 9', 49, 49'); (e) removing (31) the decorative part (1, 3, 5) thereby formed by detaching each of the stones from the support (12, 52). In accordance with a seventeenth non-limiting illustrative embodiment of the present invention, the sixteenth non-limiting embodiment is modified so that, between step (a) and step (b), the method includes the following step: (f) etching (24) at least one groove (10) in pavilions (4) of the stones so that the single base (9, 9') electrodeposited in step (d) fills each of the at least one groove (10), thus forming a securing hook; and in that, in step (c), the first layer (11, 11') is deposited over at least one part of the pavilions (4) of the stones (2).

In accordance with an eighteenth non-limiting, illustrative embodiment of the present invention, the sixteenth non-limiting embodiment is further modified so that, between step (a) and step (b), the method includes the following step: (f) etching (24) at least one groove (50) in crowns (18) of the stones so that the single base (49, 49') electrodeposited in step (d) fills each of the at least one groove (50), thus forming a securing hook; and in that, in step (c), the first layer (51, 51') is deposited over at least one part of the crowns (18) of the stones (2). In accordance with a nineteenth non-limiting illustrative embodiment of the present invention, the sixteenth, seventeenth and eighteenth non-limiting embodiments are further modified so that the support (12, 52) includes cavities (60) for receiving the stones (2). In accordance with a twentieth non-limiting embodiment of the present invention, the sixteenth, seventeenth, eighteenth and nineteenth non-limiting embodiments are further modified so that between step (c) and step (d), the method includes the following step: (g) forming (28) a frame (16, 56) around the pavé setting in order to delimit the electrodeposition of step (d) above the girdles of the stones (2). In accordance with a twenty-first non-limiting embodiment of the present invention, the sixteenth, seventeenth, eighteenth, nineteenth and twentieth non-limiting embodiments are further modified so that step (c) is performed by spraying a fluid including silver powder.

BRIEF DESCRIPTION OF THE DRAWINGS

Other features and advantages will appear clearly from the following description, given by way of non-limiting illustration, with reference to the annexed drawings, in which.

DETAILED DESCRIPTION OF PREFERRED EMBODIMENTS

Figure 1:
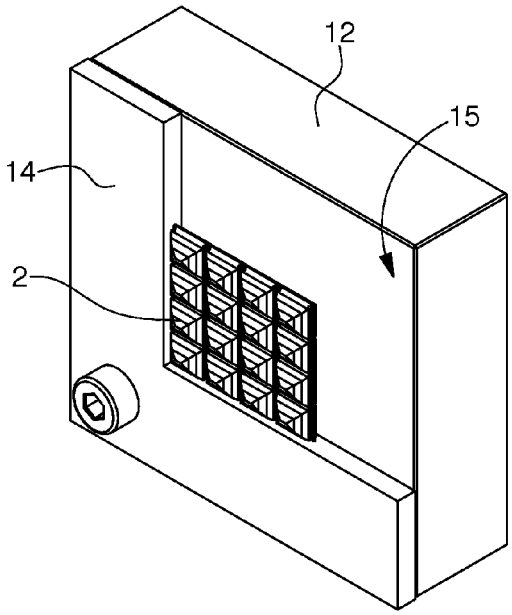
FIG. 1 is a perspective diagram of a step of securing stones according to a first embodiment of the invention.

As illustrated in FIGS. 8 to 12, 20 and 21, the invention relates to decorative parts, generally designated 1, 3 and 5 which can be added, in particular, to pieces of jewelry and timepieces (particularly on the dial and exterior part). However, these decorative parts 1, 3, 5 are not limited to the above applications. By way of example, decorative parts 1, 3, 5 could also be added to other objects, for example, glasses.

More specifically, the invention relates to a securing device 7, 7', 47, 47' for an invisible setting, for attaching several precious, semi-precious or synthetic stones 2 via the pavilion 4 or crown 18 thereof, so that the girdles 6 of the stones 2 are mounted edge-to-edge so that the tables 8 of stones 2 are substantially coplanar.

Figure 10:
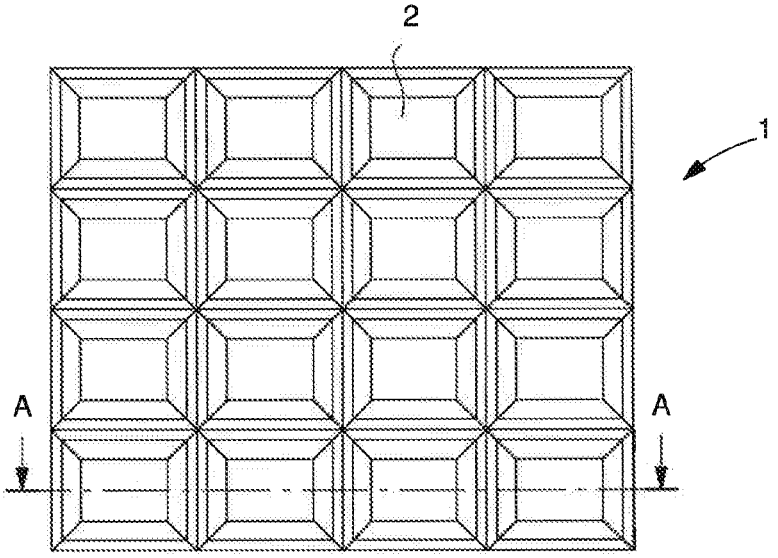
FIG. 10 is a top view of a decorative part according to the invention.
Figure 11:
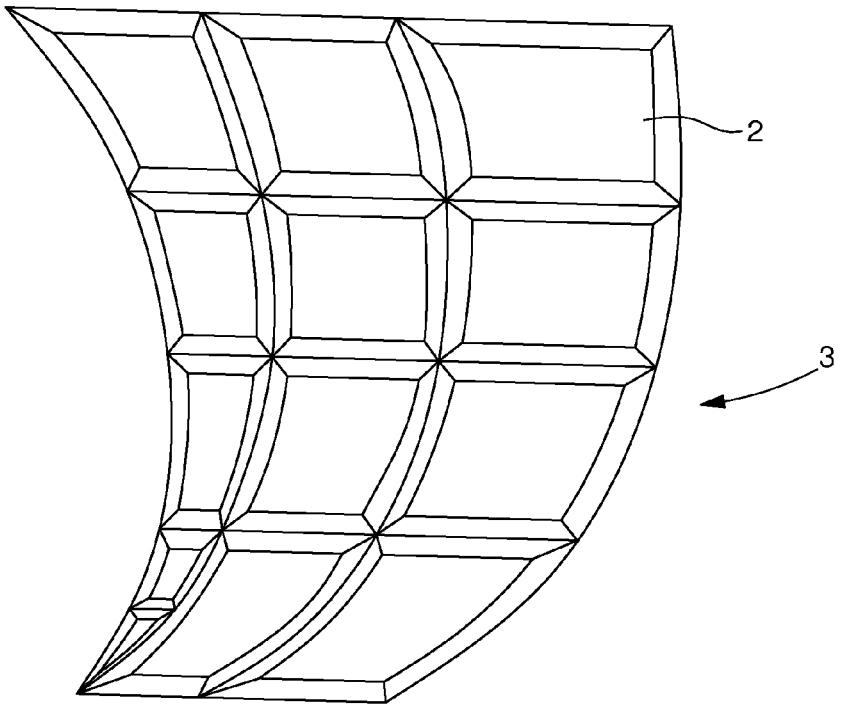
FIG. 11 is a top view of a decorative part according to a variant of the invention.
Figure 12:
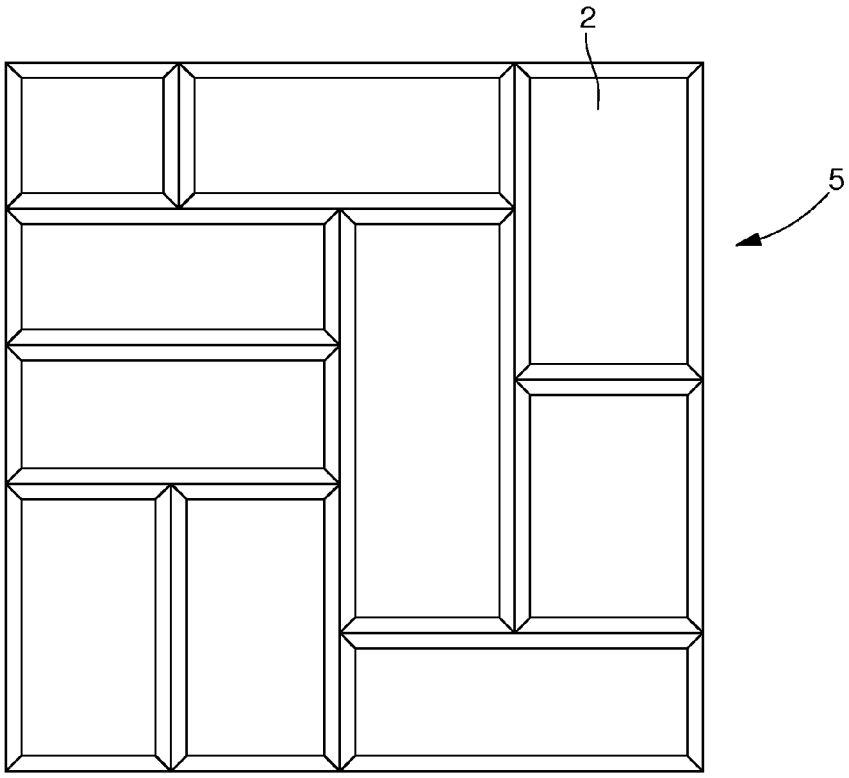
FIG. 12 is a top view of a decorative part according to another variant of the invention.

Thus, regardless of the distribution and/or shape of the stones 2 used, as illustrated for example in FIGS. 10 to 12, securing device 7, 7', 47, 47' includes a single base 9, 9', 49, 49' attaching stones 2 to each other in a very precise manner. Advantageously according to the invention and unlike the usual method for manufacturing an invisible setting, the material of the base 9, 9', 49, 49' is gradually added and not gradually removed and then deformed.

It is immediately clear that the single base 9, 9', 49, 49', which is preferably mainly electrodeposited, thus allows the pavilions 4 or crowns 18 of stones 2 to be coated with a minimum amount of mechanical stress transmitted to the stones.

Thus, advantageously according to the invention, the shape of base 9, 9', 49, 49' naturally matches pavilions 4 or crowns 18 of stones 2 whatever the dispersions thereof. This is made possible by the use of a manufacturing method 21 according to the invention, which will be explained hereinafter and which includes an electrodeposition step 29.

Figure 8:
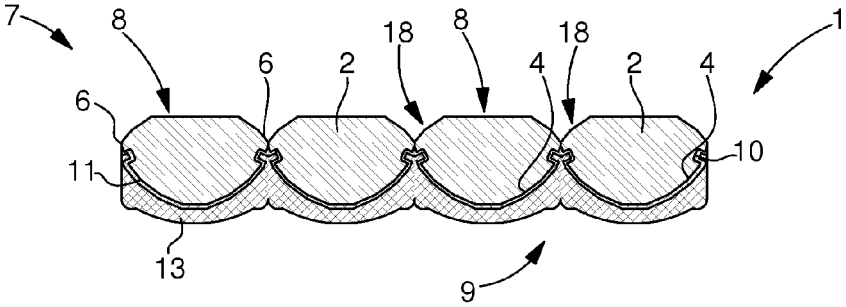
FIG. 8 is a cross-section of a decorative part according to a first embodiment of the invention.
Figure 9:
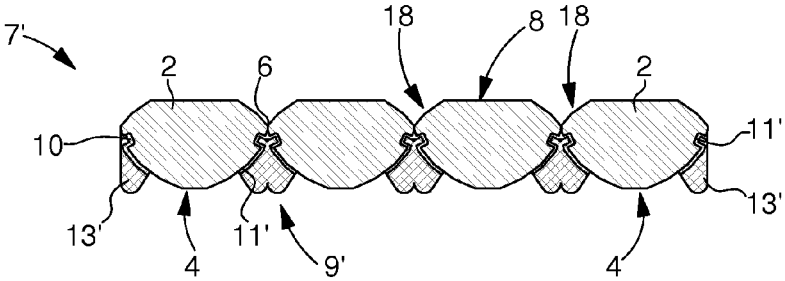
FIG. 9 is a cross-section of a decorative part according to a variant of the first embodiment of the invention.

According to a first embodiment illustrated in FIGS. 1 and 9, the single base 9, 9' includes at least two layers 11, 11' and 13, 13'. In the examples of FIGS. 5, 7, 8 and 9, the respective thicknesses of layers 11, 11' and 13, 13' are not on the same scale to aid comprehension. Indeed, the first layer 11, 11' is actually much smaller than the thickness shown in FIGS. 5, 7, 8, 9 and very small compared to the thickness of second layer 13, 13'.

The first layer 11, 11' is intended to adhere to pavilions 4 of stones 2 but also to provide an electrically conductive layer capable of acting as a seed surface for the second layer 13, 13', which will be electrodeposited. While the first layer 11, 11' has a dominant role as regards the final aesthetic appearance of decorative part 1, 3, 5, the second layer 13, 13' is mainly used for its mechanical features, i.e. it is intended to improve the solidity of decorative part 1, 3, 5.

Thus, preferably according to the invention, the first layer 11, 11' includes a material with strong reflective powers in order to be used as a reflective layer for ambient light. It is clear that this layer 11, 11' means that the brilliance of decorative part 1, 3, 5 is not reduced too much.

By way of example, depending on the products and/or materials to which decorative part 1, 3, 5 is added, the first layer 11, 11' may include gold and/or silver and/or platinum and/or palladium and/or iridium and/or copper and/or titanium and/or aluminium and/or nickel and/or tin and/or zinc. The second layer 13, 13', which, as explained above, is much thicker than the first layer 11, 11', may use the same materials as the first layer or alloys thereof.

Preferably, when the single base 9, 9' is made of silver, a protective layer, such as for example silicon nitride in a thickness of several microns, will be used as a coating to prevent the silver tarnishing due to oxidation.

In a first variant illustrated in FIG. 8, securing device 7 includes a single base 9, the two layers 11, 13 of which cover all of pavilions 4 of stones 2. This first variant provides decorative part 1, 3, 5 with maximum brilliance and/or a very homogeneous attractive appearance.

In a second variant illustrated in FIG. 9, securing device 7' has a single base 9', the two layers 11', 13' of which do not cover all of pavilions 4 of stones 2. As illustrated in FIG. 9, the single base 9' therefore forms a mesh that follows the girdles 6 of stones 2. This second variant improves the total internal reflection of stones 2 used for decorative part 1, 3, 5. It also means that the single base 9' does not have to be opened by mechanical means, for example, using a setter's tool, and thus avoids scratching stones 2.

According to a second embodiment illustrated in FIGS. 14 to 21, the single base 49, 49' thus includes at least two layers 51, 51' and 53, 53'. As in the first embodiment, in the examples of FIGS. 18 to 21, the respective thicknesses of layers 51, 51' and 53, 53' are also not on the same scale.

The first layer 51, 51' is intended to adhere to crowns 18 and possibly to tables 8 of stones 2, but also to provide an electrically conductive layer capable of acting as a seed surface for the second layer 53, 53', which will be electrodeposited. While the first layer 51, 51' has a dominant role as regards the final aesthetic appearance of decorative part 1, 3, 5, the second layer 53, 53' is mainly used for its mechanical features, i.e. it is intended to improve the solidity of decorative part 1, 3, 5.

Thus, as in the first embodiment, the first layer 51, 51' preferably includes a material with strong reflective powers in order to be used as a reflective layer for ambient light to avoid reducing the brilliance of decorative part 1, 3, 5 too much. By way of example, depending on the products and/or materials to which decorative part 1, 3, 5 is added, layers 51, 51' and 53, 53' may include materials of the same type as those of layers 11, 11' and 13, 13' respectively.

Preferably, when the single base 49, 49' is made of silver, a protective layer, such as for example silicon nitride in a thickness of several microns, will be used as a coating to prevent the silver tarnishing due to oxidation.

Figure 20:
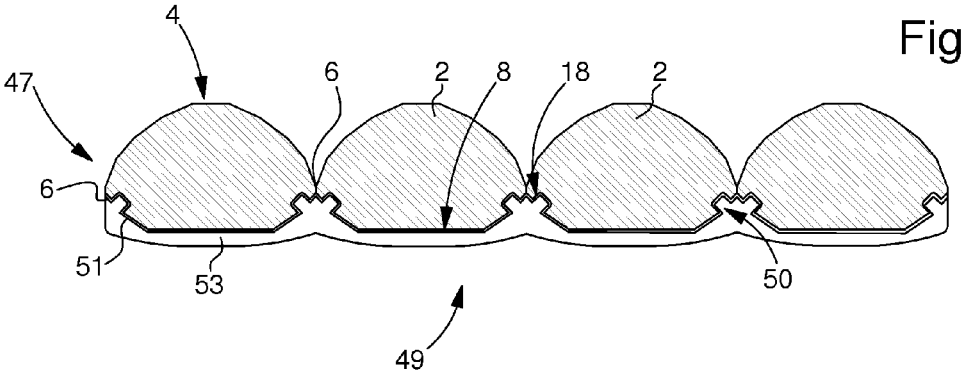
FIG. 20 is a cross-section of a decorative part according to a second embodiment of the invention.

In a first variant illustrated in FIG. 20, securing device 47 includes a single base 49, the two layers 51, 53 of which cover all of crowns 18 and tables 8 of stones 2. This first variant provides decorative part 1, 3, 5 with maximum brilliance and/or a very homogeneous attractive appearance.

Figure 21:
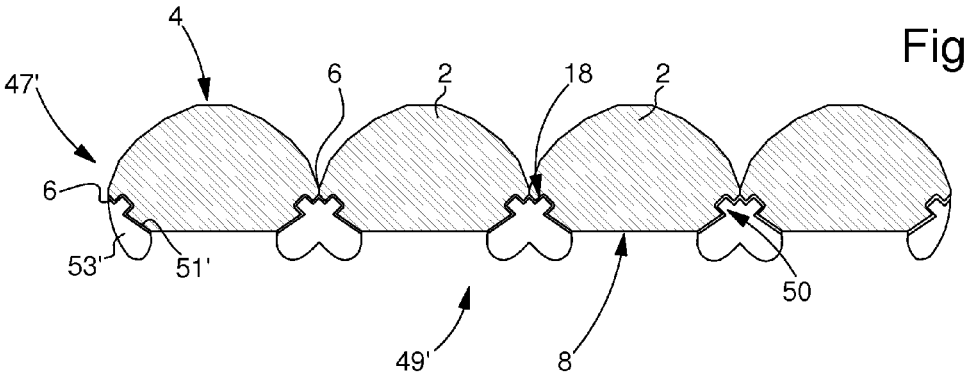
FIG. 21 is a cross-section of a decorative part according to a variant of the second embodiment of the invention.

In a second variant illustrated in FIG. 21, the securing device 47' has a single base 49', the two layers 51', 53' of which cover all of crowns 18 but not the tables 8 of stones 2. As illustrated in FIG. 21, the single base 49' therefore forms a mesh that follows the girdle 6 of stones 2. This second variant improves the total internal reflection of stones 2 used for decorative part 1, 3, 5. It also means that the single base 49' does not have to be opened by mechanical means, for example, using a setter's tool, and thus avoids scratching stones 2. Of course, base 49' may alternatively only cover part of crowns 18 or all of crowns 18 and part of tables 8 of stones 2 without departing from the scope of the invention.

The decorative part 1, 3, 5 thus formed according to any of the embodiments, even in more or less complex shapes, such as for example, a wave shape 3 illustrated in FIG. 11, a shape 5 with no particular symmetry illustrated in FIG. 12, or a totally symmetrical shape 1 illustrated in FIG. 10, may consequently easily be added to a final product via the single base 9, 9', 49, 49' thereof.

According to an alternative of the invention seen in FIGS. 3, 5, 8, 9, 17, 18, 20 and 21, in order to improve the force of attachment of securing device 7, 7', 47, 47', each of stones 2 includes at least one groove 10, 50 respectively on pavilions 4 and crowns 18. Because base 9, 9', 49, 49' perfectly matches the shape of pavilion 4 or crown 18 of stones 2, it is clear that the base 9, 9', 49, 49' then forms hooks which hold each stone 2 more firmly via the pavilion 4 or crown 18 thereof. Preferably, each stone 2 includes two grooves 10, 50 on two opposite facets of the pavilion 4 or crown 18 thereof. However, each groove 10, 50 may also form a peripheral slot in each pavilion 4 or each crown 18 so as to maximise the mechanical force of attachment of securing device 7, 7', 47, 47'.

According to another alternative of the invention, the single base 9, 9', 49, 49' may directly form the body of the final product which avoids having to add decorative part 1, 3, 5 to another body.

The method of the invention 21 will now be explained with reference to FIGS. 1 to 9 and 13 to 21. In a first step 23, the method 21 consists in taking stones 2 whose girdles 6 allow the stones to be assembled edge-to-edge in order, for example, to obtain the variants of FIGS. 10, 11 and 12, i.e. a homogeneous surface of stones 2.

In a second step 25, the stones 2 are secured one after the other to a support 12, 52. Preferably, since method 21 includes an electrodeposition step 29, support 12, 52 includes an electrically insulating material such as polypropylene or any other material compatible with method 21.

Figure 2:
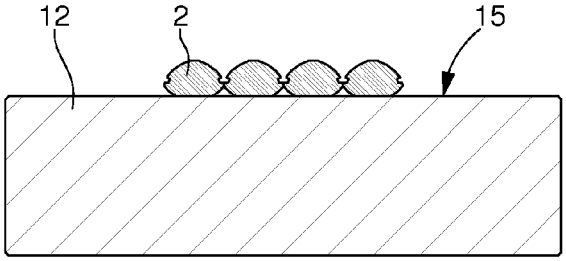
FIG. 2 is a cross-section of the end of the securing step according to a first embodiment of the invention.

In the case of the first embodiment as seen more clearly in FIG. 2, the surface 15 of support 12 to which stones 2 are added must have good flatness. Preferably, each stone 2 is secured to surface 15 of support 12 by bonding the table 8 thereof using a cyanoacrylate adhesive. Of course, other securing methods compatible with the remaining steps of method 21 or even other types of adhesive may be envisaged.

Figure 3:
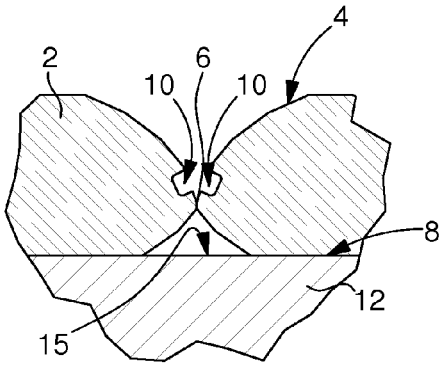
FIG. 3 is a partial enlarged diagram of FIG. 2.
Figure 4:
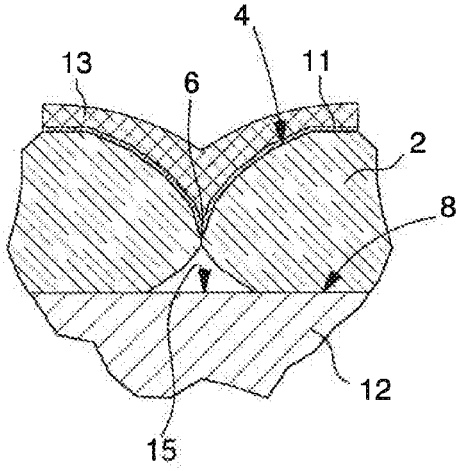
FIG. 4 is a diagram of FIG. 3 according to a variant of the invention.

FIGS. 3 and 4 show an enlargement focused on the girdles 6 of stones 2 according to two alternatives of the invention explained above. It is thus immediately clear that the cut precision of girdles 6 of stones 2 is of very great importance. Indeed, according to the invention, girdles 6 must be assembled edge-to-edge in order to limit the size of the gaps between stones 2.

Thus, as explained above, if it is not desired to improve the force of attachment of securing device 7, 7', stones 2 do not include grooves 10 and are placed against each other at their girdles 6, as illustrated in FIGS. 1 and 4. In this case, it is clear that it is only the chemical interactions between the materials that secure the stones.

Figure 13:
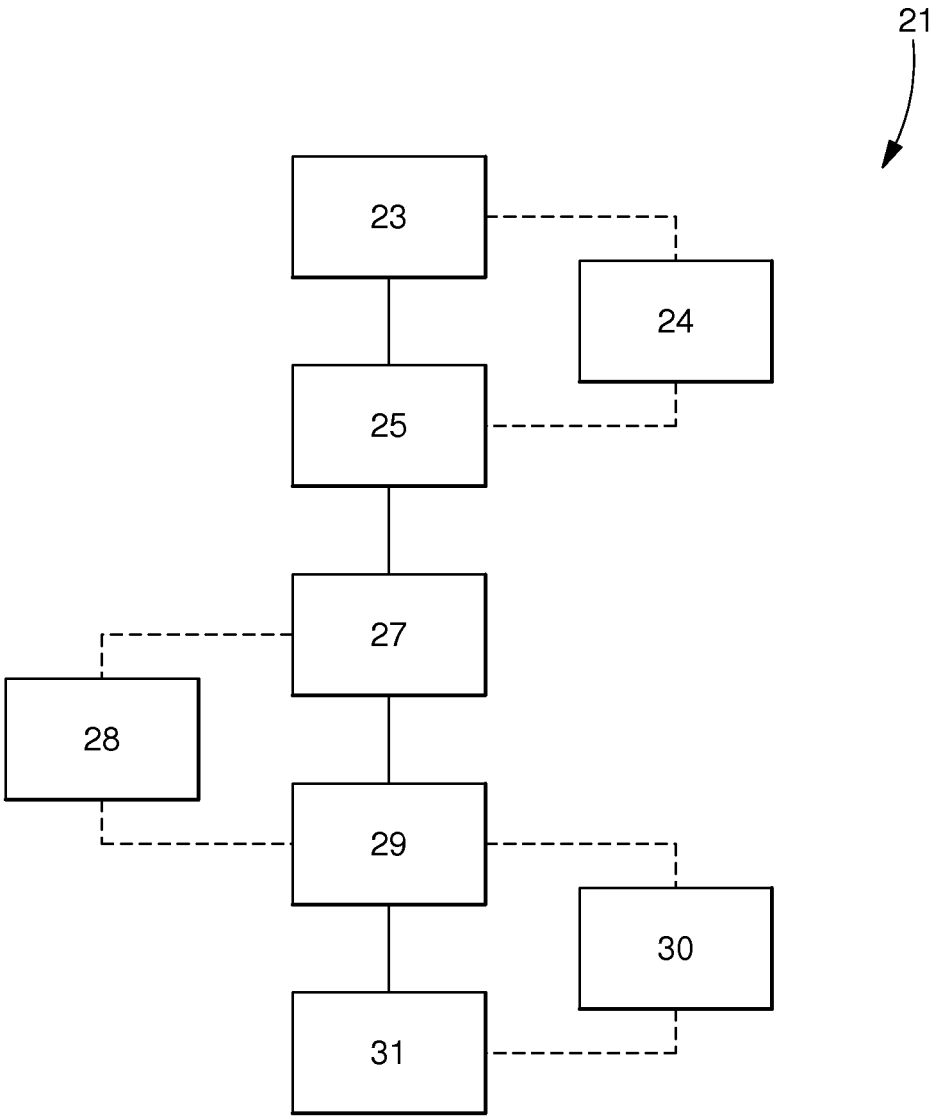
FIG. 13 is a flow diagram of the manufacturing method according to the invention.

If it is desired to improve the force of attachment of securing device 7, 7', an intermediate step 24 is necessary between step 23 and securing step 25. Step 24, shown in broken lines in FIG. 13, is for etching at least one groove 10 in at least one part of pavilions 4 of stones 2. Thus, in securing step 25, stones 2 are placed against each other at their girdles 6, as illustrated in FIGS. 1 and 3. In the embodiment example of FIG. 3, it is seen that the grooves 10 of two stones 2 face each other.

In the example illustrated in FIG. 1, it can be seen that the support 12 may also include a template 14 of dedicated shape to assist in starting the surface of stones 2. This template 14 may thus form a set square as in FIG. 1 to form a symmetrical decorative part 1 or a curved body to form a wave-shaped decorative part 3. At the end of step 25, as illustrated in FIG. 1, a pavé setting of stones 2 is thus obtained, secured by the table 8 thereof to surface 15 of support 12.

Figure 5:
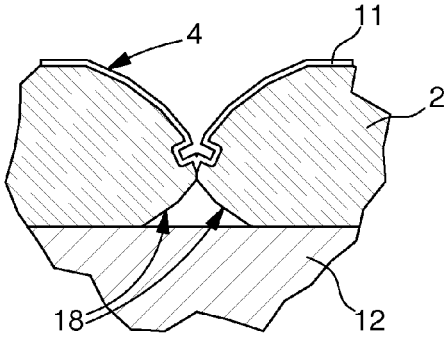
FIG. 5 is a similar diagram to FIG. 3 of a first deposition step according to a first embodiment of the invention.
Figure 6:
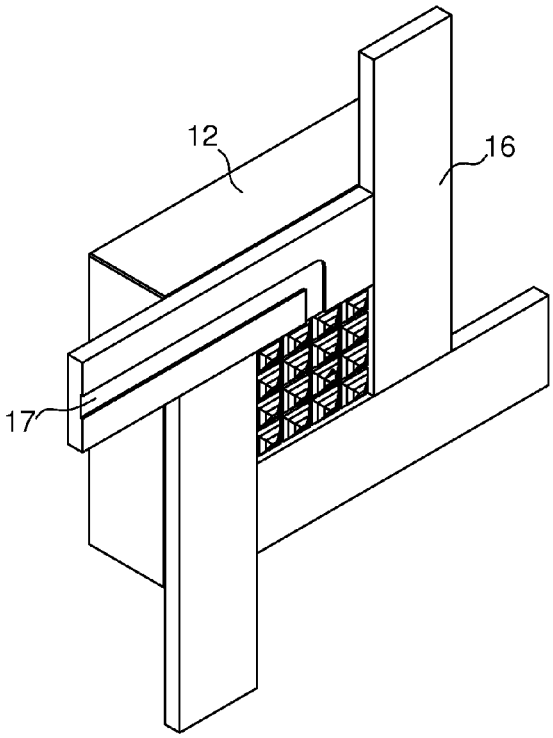
FIG. 6 is perspective diagram of a second deposition step according to a first embodiment of the invention.

Method 21 continues with a step 27 for forming the first layer 11, 11' as illustrated in FIG. 5. As explained above, the first layer 11, 11' adheres to pavilions 4 of stones 2 to act, on one hand, as a seed surface for the second layer 13, 13' and, on the other side, as a reflective layer. Thus, depending on the variant selected, the first layer 11, 11' may partially or totally coat each pavilion 4 on all or part of pavilions 4. This means that the embodiments of FIGS. 8 and 9 may also be combined to adapt the aesthetics of decorative part 1, 3, 5.

Indeed, advantageously according to the invention, only the parts that will be coated with the first layer 11, 11' in step 27 will include the single base 9, 9' in the end. It is thus clear that the diversity of aesthetic appearance of decorative part 1, 3, 5 does not make manufacturing method 21 more difficult, unlike existing manual methods.

Step 27 may be achieved via several different methods. However, the spraying a conductive varnish, such as for example a fluid including silver powder (grains of between 1 and 10 microns) is preferred. In fact, if the precision of girdles 6 is not perfectly controlled, it may be preferable to deposit a varnish of improved power coating girdles 6 so as to guarantee homogeneous growth during the next step 29. Moreover, the spray deposition method gives each stone 2 a very good aesthetic effect after electrodeposition step 29.

It is also possible to use vapour phase deposition or chemical metal deposition in addition to or instead of the above deposition. In the case of vapour phase deposition, an adhesion layer, inserted between the stone surface and the first layer 11, 11' of a few nanometers, for example a chromium, zirconium or titanium layer, may be used to improve adherence while remaining substantially invisible.

At the end of step 27, it is thus clear that layer 11, 11' prevents any deposition from passing between pavilions 4 and crowns 18, notably around girdles 6, so as to protect crowns 18, and incidentally tables 8, during electrodeposition phase 29.

According to another alternative explained above, step 27 may be followed by step 28 in broken lines and then step 29, or immediately by step 29. Thus, if the decorative part is not intended to be added to another element, method 21 can immediately pass to step 29 so as to form a single base 9, 9' which will form the rough body for the final element electrically connecting layer 11, 11'.

However, preferably, a frame 16 is added in step 28 so as to delimit the electrolytic deposition of step 29 above girdles 6 of stones 2. Of course, frame 16 may also be used to form a single base 9, 9', which will form a blank of the final element. If frame 16 is used, i.e. if step 28 is carried out, frame 16 will preferably include an electrically conductive path 17 for connecting first layer 11, 11'. Moreover, the walls of frame 16 surrounding stones 2 are preferably electrically conductive.

Figure 7:
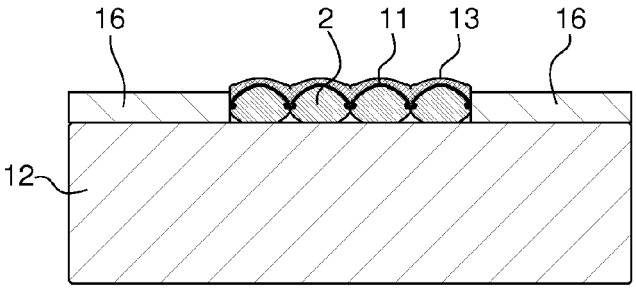
FIG. 7 is a cross-section of the end of the second deposition step according to a first embodiment of the invention.

Method 21 continues with step 29 consisting in electrodepositing the second layer 13, 13' from first layer 11, 11' so as to finish making single base 9, 9' as illustrated in FIG. 7. Finally, in a last step 31 of method 21, the decorative part 1, 3, 5 thereby formed is detached from support 12, as is frame 16, if used.

Of course, between steps 29 and 31 or possibly after step 31, a machining and/or polishing step 30 may be performed so as to modify the shape of single base 9, 9', either to form the final element, or to adapt the shape for addition to the final element.

Figure 14:
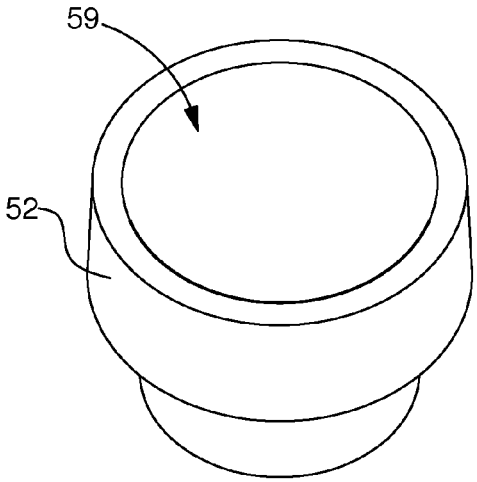
FIGS. 14 to 16 are diagrams of steps for securing stones according to a second embodiment of the invention.
Figure 15:
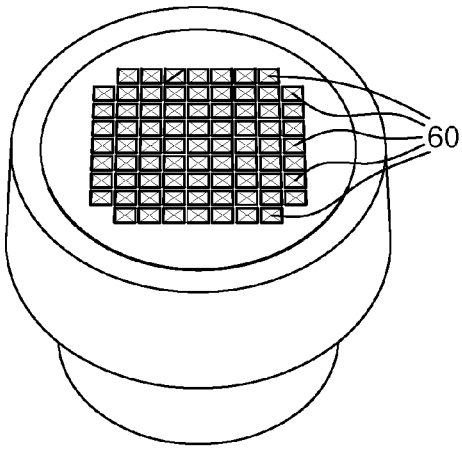
Figure 16:
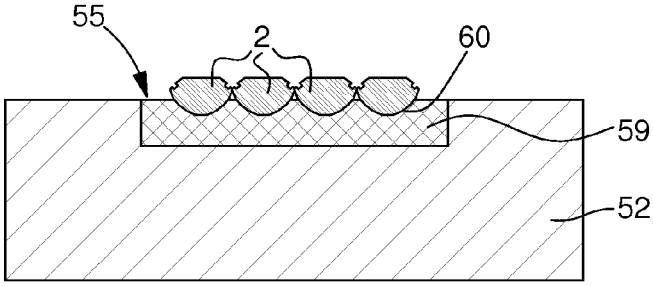

In the case of the second embodiment, as seen more clearly in FIGS. 14 to 16, support 52 to which stones 2 are added is substantially different from that of the first embodiment. Indeed, in the second embodiment, stones 2 are not added via their substantially flat tables 8, but via their substantially pyramidal pavilions 4.

Thus, advantageously according to the invention, the support 52 according to the second embodiment includes a plate 59, as seen in FIG. 14, formed of an easily deformable material, for example an SnBi alloy. Plate 59 is intended to be stamped with cavities 60 that are shaped and distributed in a substantially identical manner to pavilions 4 of stones 2 as seen in FIG. 15. This stamped plate 59 according to the second embodiment allows work to be performed with similar precision to the first embodiment.

Figure 17:
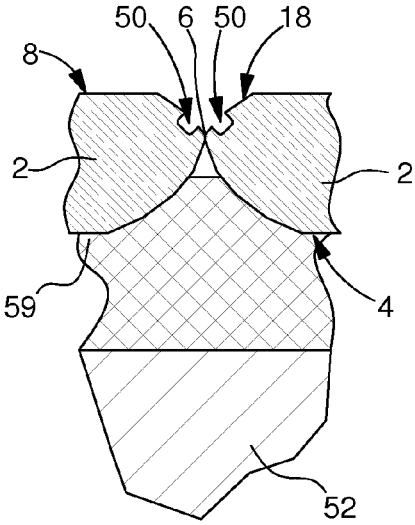
FIG. 17 is a partial enlarged diagram of FIG. 16.

Preferably, each stone 2 is secured in a cavity 60 on the surface 55 of support 52 by bonding the pavilion 4 thereof using a similar adhesive to the first embodiment. FIG. 17 shows an enlargement focussed on girdles 6 of stones 2. It is clear, as for the first embodiment, that the cut precision of girdles 6 of stones 2 is also of very great importance. Indeed, girdles 6 must be assembled edge-to-edge so as to limit the size of the gaps between stones 2.

The example illustrated in FIG. 17 is that wherein it is desired to improve the force of attachment of securing device 47, 47', i.e. wherein stones 2 include at least one groove 50 on the crown 18 thereof. However, as for FIG. 4 of the first embodiment, these grooves 50 may not be present.

Thus, in the case of FIG. 17, an intermediate step 24, shown in broken lines in FIG. 13, is for etching at least one groove 50 in at least one part of crowns 18 of stones 2. Thus, in securing step 25, stones 2 are placed against each other at their girdles 6, as illustrated in FIGS. 16 and 17. In the embodiment example of FIG. 17, it is seen that the grooves 50 of two stones 2 face each other.

Unlike the first embodiment, it is no longer necessary to use a template. Indeed, cavities 60 allow stones 2 to be distributed in relation to each other. However, in the second embodiment, a slight stress must be applied to tables 8 of stones 2 at the end of step 25 so as to perfect the flatness thereof and decrease the gaps between girdles 6 of stones 2 as much as possible. At the end of step 25, a pavé setting of stones 2 is thus obtained, secured via their pavilions 4 to the surface 55 of support 52.

Figure 18:
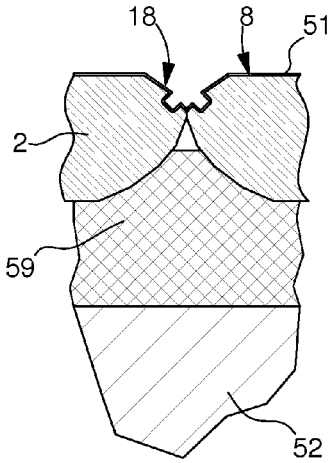
FIG. 18 is a similar diagram to FIG. 17 of a first deposition step according to a second embodiment of the invention.

Method 21 continues with a step 27 for forming the first layer 51, 51' as illustrated in FIG. 18. As explained above, the first layer 51, 51' adheres to crowns 18 and possibly to tables 8 of stones 2 to act, on one side, as a seed surface for the second layer 53, 53', and on the other side as a reflective layer. Thus, depending on the variant selected, the first layer 51, 51' may partially or totally coat each crown 18 on all or part of crowns 18 and possibly partially or totally coat each table 8 on all or part of tables 8. This means that the embodiments of FIGS. 20 and 21 may also be combined to adapt the aesthetics of decorative part 1, 3, 5.

Indeed, advantageously according to the invention, only the parts that will be coated with the first layer 51, 51' in step 27 will include the single base 49, 49' in the end. It is thus clear that the diversity of aesthetic appearance of decorative part 1, 3, 5 does not make manufacturing method more difficult, unlike existing manual methods. As in the first embodiment, step 27 is preferably performed by spraying an electrically conductive varnish, such as for example a fluid including silver powder (grains between 1 and 10 microns). However, other types of deposition are also possible in addition to or in place of the above deposition.

At the end of step 27, it is thus clear that layer 51, 51' prevents any deposition from passing between pavilions 4 and crowns 18, notably around girdles 6, so as to protect pavilions 4, during electrodeposition phase 29.

According to another alternative explained above, step 27 may be followed by step 28 in broken lines and then step 29, or immediately by step 29. Thus, if the decorative part is not intended to be added to another element, method 21 can immediately pass to step 29 so as to form a single base 49, 49' which will form the rough body for the final element electrically connecting layer 51, 51'.

However, preferably, a frame 56 is added in step 28 so as to delimit the electrolytic deposition of step 29 above girdles 6 of stones 2. Of course, frame 56 may also be used to form a single base 49, 49' which will form a blank of the final element. If frame 56 is used, it will have the same features as frame 16 of the first embodiment.

In comparison with the first embodiment, since the second embodiment preferably uses a plate 59, in addition to being soft, the material will be adapted to melt easily, i.e. to have a low melting point, such as for example around 80° C. for the alloy SnBi. Step 31 is thus facilitated by melting plate 59, which releases pavilions 4 of stones 2 from support 52 without modifying the nature of the base 49, 49'.

Figure 19:
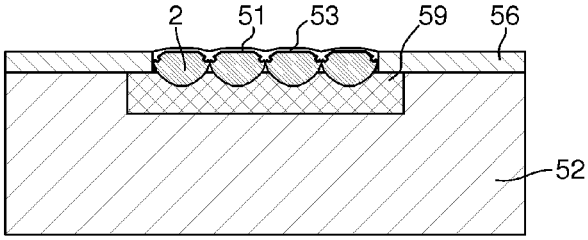
FIG. 19 is a cross-section of the end of the second deposition step according to a second embodiment of the invention.

Method 21 continues with step 29, consisting in electrodepositing the second layer 53, 53' from first layer 51, 51' so as to finish making single base 49, 49' as illustrated in FIG. 19. Finally, in a last step 31 of method 21, the decorative part 1, 3, 5 thereby formed is detached from support 52, as is frame 56, if used.

Of course, between steps 29 and 31 or possibly after step 31, a machining and/or polishing step 30 may be performed so as to modify the shape of single base 49, 49', either to form the final element, or to adapt the shape for addition to the final element.

From reading the above explanations of two embodiments, it is clear that method 21 allows great diversity in the decorative parts, such as for example, those of FIGS. 10 to 12, which have the geometry of a pavé setting with diverse stone shapes, without complicating implementation of the method, which means the method can be applied to any kind of precious, semi-precious or synthetic stone at reduced cost.

Moreover, pavilions 4 or crowns 18 may or may not be all or partly pierced without any requirement for subsequent touching up steps. It is also remarkable, according to the invention, that stones 2 may be higher or lower and/or of different shapes and/or distributed more or less symmetrically and that the heights, angles and depths of grooves 10, 50 may be greater or smaller, without increasing the complexity of method 21. Finally, according to the invention, manufacturing conditions are improved by working directly with the pavilion 4 or crown 18 of stones 2, which is not possible with current methods which require the piece of work to be turned over continually to check whether stones 2 are properly assembled.

This peculiarity is all the more advantageous in any after sales operations which require a single stone or part of the stones to be replaced. Thus, using current, mechanical, invisible setting methods, it is very difficult to remove a stone and this involves a high risk of scratching, cracking or chipping the stones close to the stone to be replaced. Conversely, advantageously according to the invention, it is possible to spare the adjacent stones, by removing, for example chemically, the metal from the stone to be removed and then to bond a new stone in place of the old one and reform the entire single base thus considerably reducing the risk of scratching, cracking or chipping the other stones in the pavé setting.

The only restriction of method 21 concerns respecting the height of girdles 6 so as to prevent gaps forming between stones 2 in step 25.

Finally, another advantage of the manufacturing method 21 according to the invention concerns savings in time and incidentally costs. Indeed, not only is manufacturing method 21 much shorter compared to a manual method, but steps 27 and/or 29 can be performed at the same time for several decorative parts 1, 3, 5 from several supports 12, 52 or from a single support 12, 52.

Of course, this invention is not limited to the illustrated example but is capable of various variants and alterations that will appear to those skilled in the art. In particular, variants other than those shown in FIGS. 10 to 12 are possible.

Moreover, it is perfectly possible to envisage that the surface 15, 55 of support 12, 52 is not flat to obtain a decorative part 1, 3, 5 wherein tables 8 of stones 2 are not coplanar.

Finally, it is perfectly possible to envisage replacing template 14 of the first embodiment with the use of a stamp of the type used in the second embodiment which is shaped and distributed in a substantially manner to the assemblies of crowns 18-tables 8. Further, to facilitate removal of plate 59 in step 31, support 52 may be hollow to allow access to at least one part of the back of plate 59.

Whichever embodiment is used, by way of alternative, plate 59 including cavities 60 may also be made from a resin moulded on pavilions 4 of the stones 2 which will actually be used. Thus, instead of the stones 2 being assembled one by one in a cavity 60 in plate 59 and then pushed in with slight stress, the resin would be duplicate overmoulded on stones 2 and mounted on support 12, 52.

To summarize then, the present invention, when broadly construed, relates to an invisible set decorative part (1, 3, 5) that includes several stones (2) and a device (7, 7', 47, 47') for securing the stones (2) in relation to each other. According to the invention, the securing device (7, 7', 47, 47') includes a single electrodeposited base (9, 9', 49, 49') whose shape matches one part of the stones, thus allowing all the stones (2) to be attached in relation to each other without any stress, and the girdles (6) of the stones (2) are mounted edge-to-edge in relation to each other so that the single base is concealed. The invention also relates to a method for manufacturing a part (1, 3, 5) of this type. The invention concerns the field of pieces or jewelry or timepieces.

The invention claimed is:

1. A method of manufacturing a decorative part with an invisible setting, wherein the method comprises:

providing several stones, wherein each stone includes a girdle;

securing each stone against a support, wherein the girdles of the stones are mounted edge-to-edge in relation to each other so as to form a pavé stone setting;

depositing a first electrically conductive layer on at least one part of the stones;

electrodepositing a second layer from the first electrically conductive layer so as to form the invisible setting made of a single electrodeposited base so that all the stones are attached in relation to each other without any stress, wherein a part of each stone is secured against the support forming a part of a visible surface of the decorative part, the decorative part comprising the single electrodeposited base that is concealed by the visible surface formed by the stones;

removing the decorative part thereby formed from the support by detaching each of the stones from the support.

2. The method according to claim 1, wherein each stone includes a pavilion, and between the providing and the securing, the method further comprises:

etching one or more grooves in pavilions of said stones so that the single electrodeposited base in the electrodepositing fills each of said one or more grooves so as to form a securing hook;

and wherein, in the depositing, the first electrically conductive layer is deposited over at least one part of the pavilions of the stones.

3. The method according to claim 1, wherein each stone includes a crown, and between the providing and the securing, the method further comprises:

etching one or more grooves in crowns of said stones so that the single electrodeposited base in the electrodepositing fills each of said one or more grooves so as to form a securing hook;

and wherein, in the depositing, the first electrically conductive layer is deposited over at least one part of the crowns of the stones.

4. The method according to claim 1, wherein the support includes cavities for receiving the stones.

5. The method according to claim 1, wherein between the depositing and the electrodepositing, the method further comprises:

Forming a frame around said pave stone setting in order to delimit the electrodeposition of the electrodepositing above said girdles of the stones.

6. The method according to claim 1, wherein the depositing is performed by spraying a fluid including silver powder.

* * * * *